US006224402B1

(12) United States Patent
Kumakura et al.

(10) Patent No.: US 6,224,402 B1
(45) Date of Patent: May 1, 2001

(54) MOTION TRANSMISSION MECHANISM AND LOW INSERTION FORCE CONNECTOR

(75) Inventors: Hideto Kumakura; Shinji Kodama, both of Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/229,688

(22) Filed: Jan. 13, 1999

(30) Foreign Application Priority Data

Jan. 13, 1998 (JP) ..... 10-004937

(51) Int. Cl.[7] ..... H01R 13/62
(52) U.S. Cl. ..... 439/157; 439/314
(58) Field of Search ..... 439/157, 347, 439/152, 314–319; 74/104; 285/361, 412, 396, 314

(56) References Cited

U.S. PATENT DOCUMENTS 3,049,690 * 8/1962 Sparber ..... 439/258
3,681,739 * 8/1972 Kornick ..... 339/94 C
5,899,762 * 3/1999 Ainceri ..... 439/157
5,928,013 * 7/1999 Iwahori ..... 439/157
5,957,710 * 9/1999 Nagano ..... 439/157
5,964,603 * 10/1999 Hanazaki et al. ..... 439/157

FOREIGN PATENT DOCUMENTS 4-319271 11/1992 (JP) ..... H01R/13/629
5-114436 5/1993 (JP) ..... H01R/13/629

* cited by examiner

*Primary Examiner*—Brian Sirous
*Assistant Examiner*—Michael C. Zarroli
(74) *Attorney, Agent, or Firm*—Sughrue, Mion, Zinn, Macpeak & Seas, PLLC

(57) ABSTRACT

In a low insertion force connector, cam grooves are formed in a slider for imparting a motion, and guide pins are formed on a connector holder for receiving the motion, and the slider and the holder are connected together, with the guide pins engaged respectively in the cam grooves, and when the slider is moved, the guide pins are moved respectively along the guide grooves, thereby moving the holder, so that the connector is fitted into a mating connector. Radiused grooves 22 of an arcuate cross-section are formed in those surfaces from which the guide pins 21 project, each of the radiused grooves being continuous with a proximal end of the associated guide pin 21.

8 Claims, 6 Drawing Sheets

MOTION TRANSMISSION MECHANISM AND LOW INSERTION FORCE CONNECTOR

BACKGROUND OF THE INVENTION

1. Field of the Invention

This invention relates to a -motion transmission mechanism utilizing cam grooves and guide pins, and also relates to a low insertion force connector using this motion transmission mechanism. More specifically, the invention relates to a motion transmission mechanism and a low insertion force connector, in which the concentration of a stress on guide pins due to a notch effect is alleviated while achieving a compact design of the device.

2. Related Art

There is known a motion transmission mechanism in which cam grooves are formed in a driver (which imparts a motion to other member in the mechanism), and guide pins are formed on a follower (which is moved by the driver), and the guide pins are engaged respectively in the cam grooves, and such a motion transmission mechanism has been used in various mechanical devices and apparatuses.

In this motion transmission mechanism, when the driver is moved, the guide pins are moved along the respective cam grooves to thereby move the follower.

Such a motion transmission mechanism has heretofore been extensively used as a so-called low insertion force mechanism, and one example thereof is proposed in Japanese Patent Unexamined Publication Hei. 4-319271.

A low insertion force connector, disclosed in Japanese Patent Unexamined Publication Hei. 4-319271, will be described with reference to FIG. 5 which is an exploded, perspective view.

In this Figure, the conventional low insertion force connector comprises two male connectors 10A and 10B, a rectangular frame-like holder 20 for receiving the male connectors 10A and 10B, a female connector 30 for fitting on the male connectors 10A and 10B received in the holder 20, and a generally U-shaped slider 40 for inserting and withdrawing the male connectors 10A and 10B relative to the female connector 30.

Guide pins 121 and 121 are formed on each of upper and lower side walls of the holder 20, and insertion holes 31 and 31 are formed through each of opposite end walls of the female connector 30, and cam grooves 41 and 41 for respectively receiving the associated guide pins 121 on the holder 20 are formed in each of upper and lower side walls of the slider 40.

In the conventional low insertion force connector of the above construction, the slider 40 is inserted into a predetermined position in the female connector 30, and the guide pins 121 on the holder 20 are fitted respectively in the cam grooves 41 in the slider 40.

Then, when the slider 40 is pushed into the female connector 30, the guide pins 121 are moved respectively along the cam grooves 41, so that male connectors 10A and 10B, received in the holder 20, are fitted into the female connector 30.

In the above conventional low insertion force connector, the boundary between the holder 20 and each guide pin 121 is an angle portion 121*b* as shown in FIG. 6(*a*), and therefore when the slider 40 is slid, a notch effect is produced, and more specifically a stress, imparted to the guide pin 121 by the cam groove 41, concentrates on the angle portion 121*b*, which results in a problem that the strength is reduced.

Therefore, in order to alleviate the concentration of the stress on the guide pin due to the notch effect, there has heretofore been used a method in which the proximal end portion of a guide pin 122 is chamfered to form a radiused (curved) portion 122*b*.

As shown in FIGS. 7(*a*) and 7(*b*), the conventional guide pin 122 comprises a pin body 122*a*, substantially serving as a guide, and the radiused portion 122*b* for alleviating the stress.

In order that the pin body 122*a* can substantially serve as the guide, the pin body 122*a* must have a length equal to that of the guide pin 121 shown in FIG. 6(*a*).

Therefore, the length of projecting of the guide pin 122 is increased by an amount equal to the height of the radiused portion 122*b*, which results in a problem that the overall size of the low insertion force connector is increased.

In the case where a large stress is applied to the guide pin 122, it is necessary to increase the length of the pin body 122*a* and also to increase the size of the radiused portion 122*b*, and therefore there is encountered a problem that the overall size of the low insertion force connector is more increased.

And besides, a clearance, equal to the height of the radiused portion 122*b*, is formed between the slider 40 and the holder 20 (that is, the surface from which the guide pin 122 projects), and therefore when the slider 40 is slid, a load is concentrated on those surfaces of each guide pin 122 and the associated cam groove 41 which are held in sliding contact with each other, and this results in a problem that an abnormal sound is produced by the friction between the guide pin and the cam groove.

SUMMARY OF THE INVENTION

This invention has been made in view of the above problems, and an object of the invention is to provide a motion transmission mechanism and a low insertion force connector, in which the concentration of a stress on guide pins due to a notch effect is alleviated while achieving a compact design of the device, and also the production of an abnormal sound is positively prevented.

The above object of the invention has been achieved by a motion transmission mechanism wherein cam grooves are formed in a driver for imparting a motion, and guide pins are formed on a follower for receiving the motion, and the driver and the follower are connected together, with the guide pins engaged respectively in the cam grooves, and when the driver is moved, the guide pins are moved respectively along the guide grooves, thereby moving the follower; and radiused grooves of an arcuate cross-section are formed in those surfaces from which the guide pins project, each of the radiused grooves being continuous with a proximal end of the associated guide pin.

In this construction, that portion around the proximal end of each guide pin is chamfered to form the radiused groove, and by doing so, the length of projecting of the guide pin can be reduced.

With this construction, the concentration of a stress on each guide pin due to a notch effect can be alleviated while achieving a compact design of the device.

And besides, the radiused groove will not interfere with the driver, and therefore any clearance will not be formed between the driver and the surface from which the guide pin projects.

Therefore, when the driver is in contact with the surfaces, from which the guide pins project, and is moved, the load, acting on those surfaces of each cam groove and the associated guide pin which are held in contact with each other, can be reduced, and therefore the production of an abnormal sound due to the friction between the cam groove and the guide pin is positively prevented.

In the motion transmission mechanism of the present invention, when the driver is moved linearly, the follower is moved linearly. In the motion transmission mechanism of the present invention, when the driver is rotated, the follower is moved linearly.

With either of these constructions, the concentration of the stress on each guide pin due to a notch effect can be alleviated while achieving the compact design of the device, and also the production of an abnormal sound is positively prevented.

The above object of the invention has also been achieved by a low insertion force connector wherein cam grooves are formed in an operating member for imparting a motion, and guide pins are formed directly or indirectly on a connector for receiving the motion, and the operating member and the connector are connected together, with the guide pins engaged respectively in the cam grooves, and when the operating member is moved, the guide pins are moved respectively along the guide grooves, so that the connector is moved to be fitted in a mating connector; and radiused grooves of an arcuate cross-section are formed in those surfaces from which the guide pins project, each of the radiused grooves being continuous with a proximal end of the associated guide pin.

In this construction, that portion around the proximal end of each guide pin is chamfered to form the radiused groove, and by doing so, the length of projecting of the guide pin can be reduced.

With this construction, the concentration of a stress on each guide pin due to a notch effect can be alleviated while achieving a compact design of the device.

And besides, the radiused groove will not interfere with the operating member, and therefore any clearance will not be formed between the operating member and the surface from which the guide pin projects.

Therefore, when the operating member is in contact with the surfaces, from which the guide pins project, and is moved, the load, acting on those surfaces of each cam groove and the associated guide pin which are held in contact with each other, can be reduced, and therefore the production of an abnormal sound due to the friction between the cam groove and the guide pin is positively prevented.

In the low insertion force connector of the present invention, the operating member is a linearly-movable slider, and when the slider is moved linearly, the connector is moved linearly to be fitted into the mating connector. In the low insertion force connector of the present invention, the operating member is a rotary member, and when the rotary member is rotated, the connector is moved linearly to be fitted into the mating connector.

With either of these constructions, the concentration of the stress on each guide pin due to a notch effect can be alleviated while achieving the compact design of the device, and also the production of an abnormal sound is positively prevented as described above for the construction of the present invention.

BRIEF DESCRIPTION OF THE DRAWINGS

FIG. 3(*b*) is an enlarged view of a portion of FIG. 3(*a*;

FIG. 7(*b*) is an enlarged view of a portion of FIG. 7(*a*).

DETAILED DESCRIPTION OF THE PRESENT INVENTION

Figure 1:
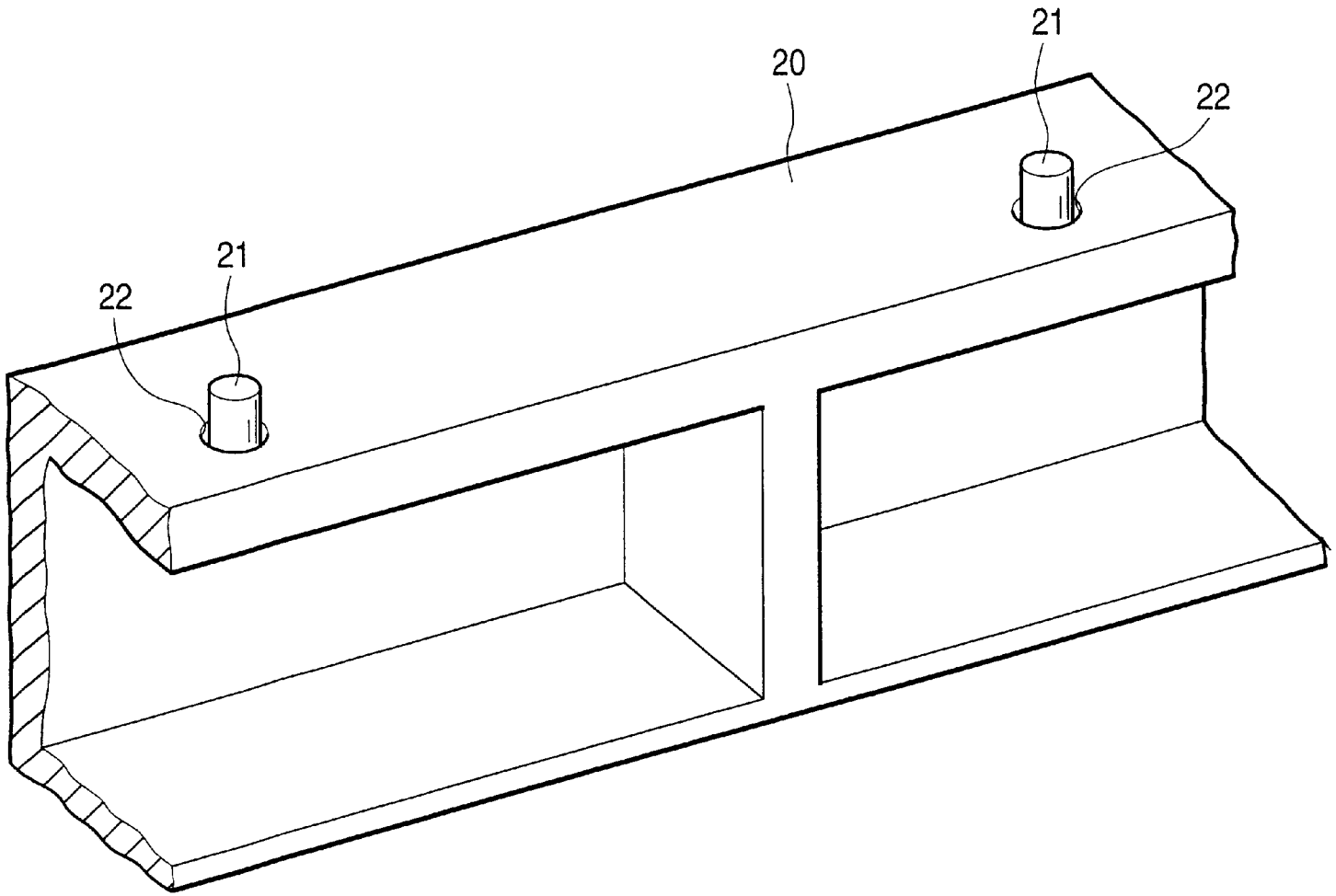
FIG. 1 is an enlarged view of a portion of a holder in a first embodiment of a low insertion force connector of the invention.

A preferred embodiment of a motion transmission mechanism of the present invention, as well as a preferred embodiment of a low insertion force connector of the invention, will be described with reference to the drawings.

In this embodiment, the two inventions will be described at the same time with reference to a low insertion force connector using a motion transmission mechanism.

In the following embodiments, those portions identical to those of the conventional construction will be designated by identical reference numerals, respectively, and detailed description thereof will be omitted.

A first embodiment of a low insertion force connector (motion transmission mechanism) of the invention will now be described.

Figure 2:
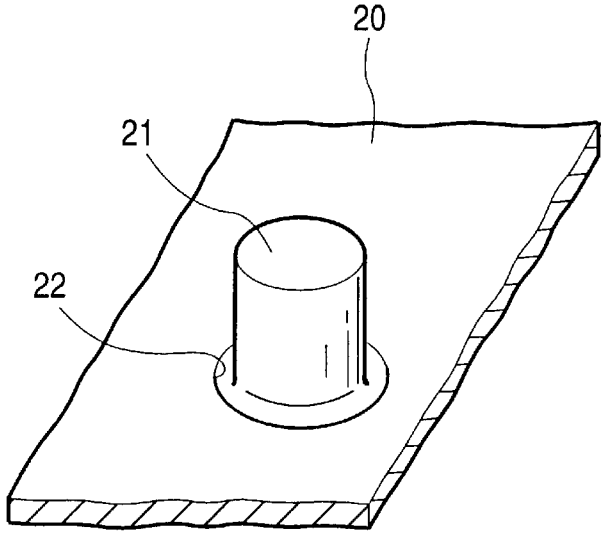
FIG. 2 is an enlarged, fragmentary view showing a guide pin on the holder and a radiused groove in the holder.
Figure 3:
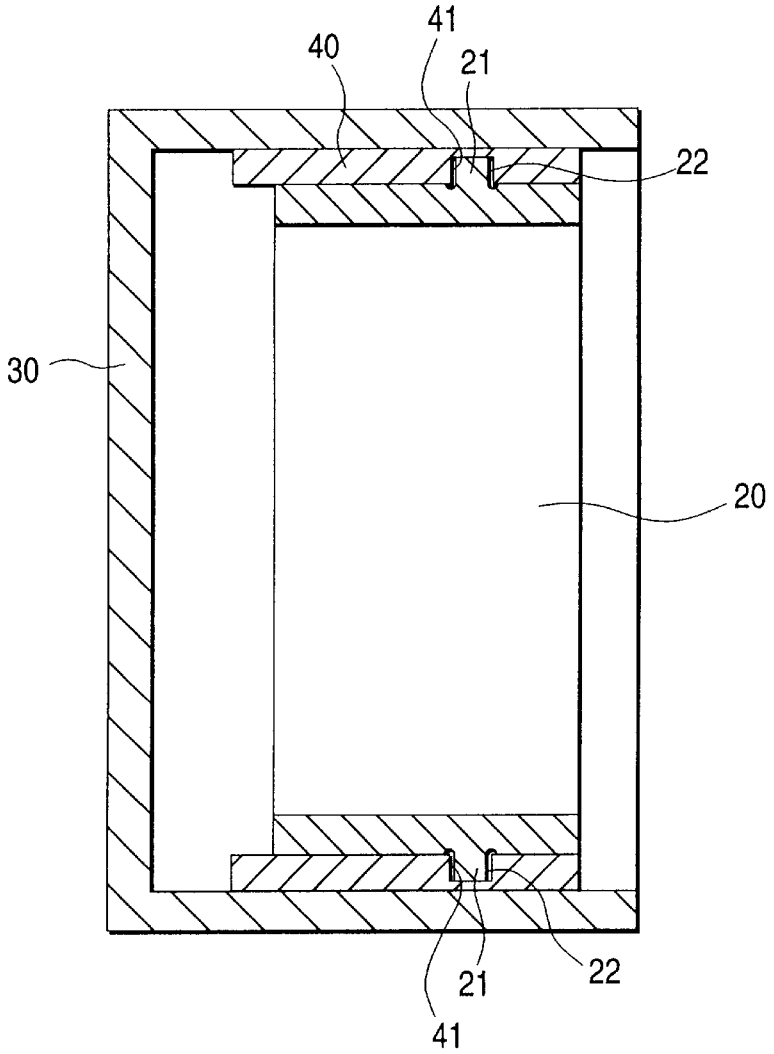
FIG. 3(*a*) is a cross-sectional view of the low insertion force connector.
Figure 3:
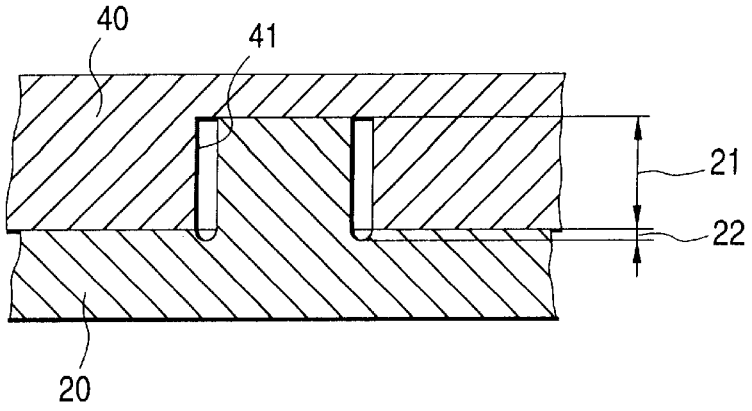

FIG. 1 is an enlarged view of a portion of a holder in the first embodiment of the low insertion force connector of the invention, and FIG. 2 is an enlarged, fragmentary view showing a guide pin on the holder and a radiused groove in the holder. FIG. 3(*a*) is a cross-sectional view of the low insertion force connector, and FIG. 3(*b*) is an enlarged view of a portion of FIG. 3(*a*).

Figure 5:
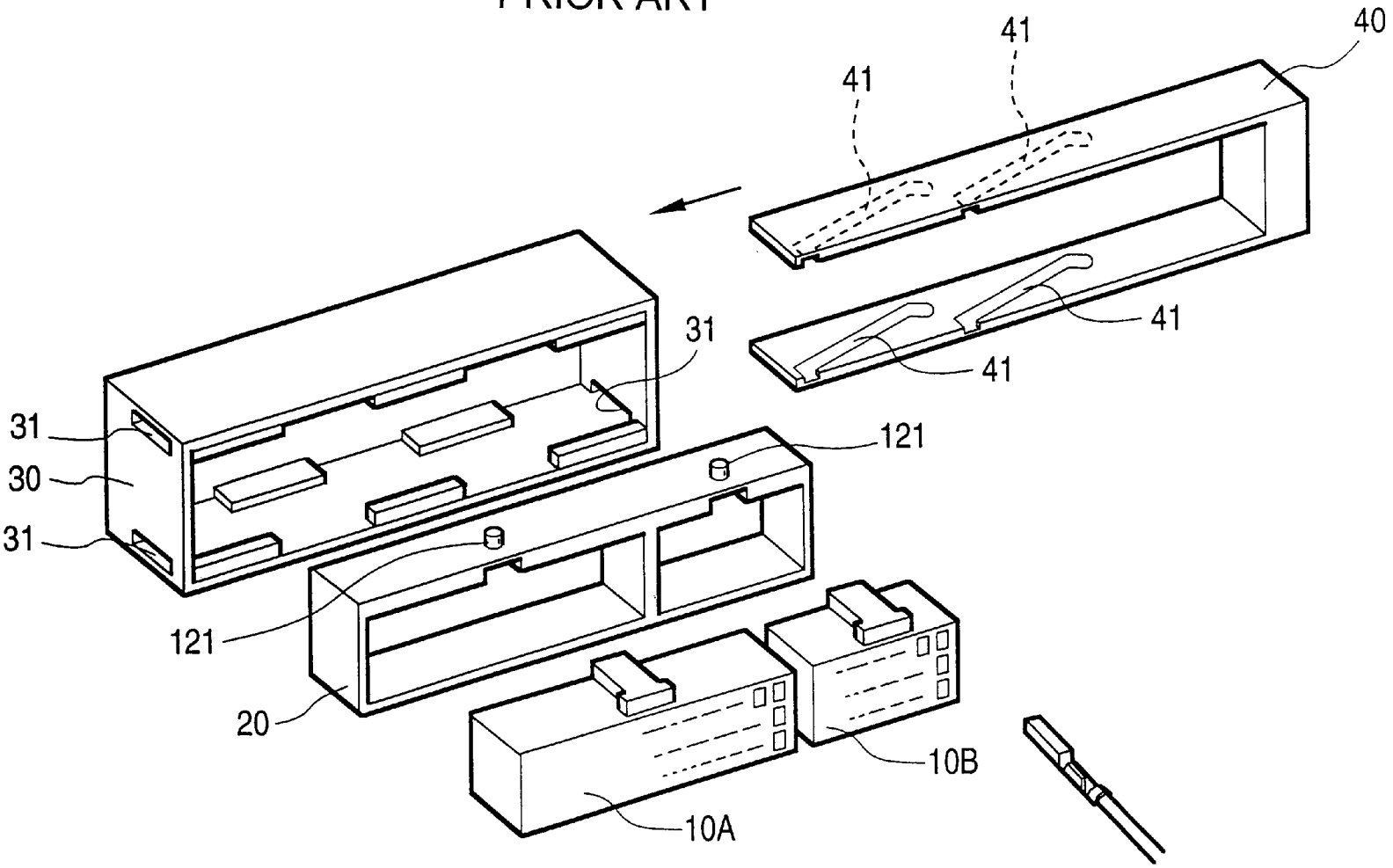
FIG. 5 PRIOR ART
FIG. 5 is an exploded, perspective view of a conventional low insertion force connector.
Figure 6:
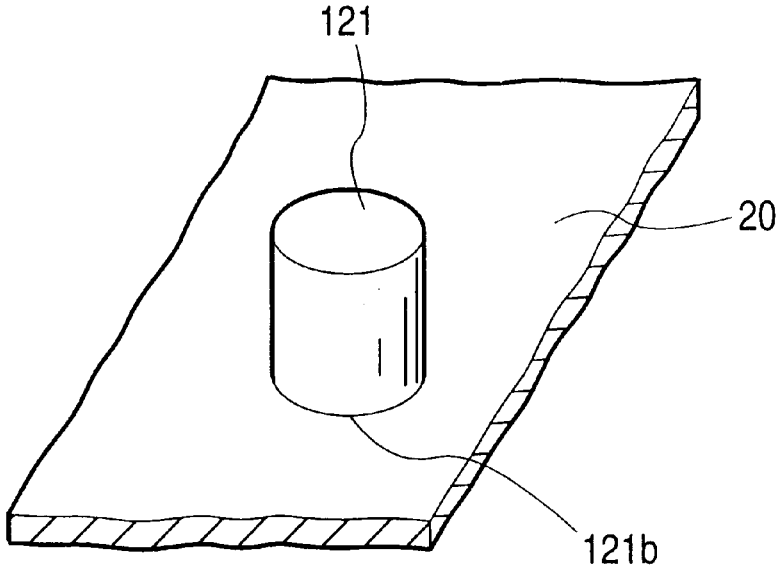
FIG. 6 (a) PRIOR ART
FIGS. 6(*a*) and 6(*b*) are enlarged, fragmentary views showing guide pins of the conventional low insertion force connector, respectively.
Figure 6:
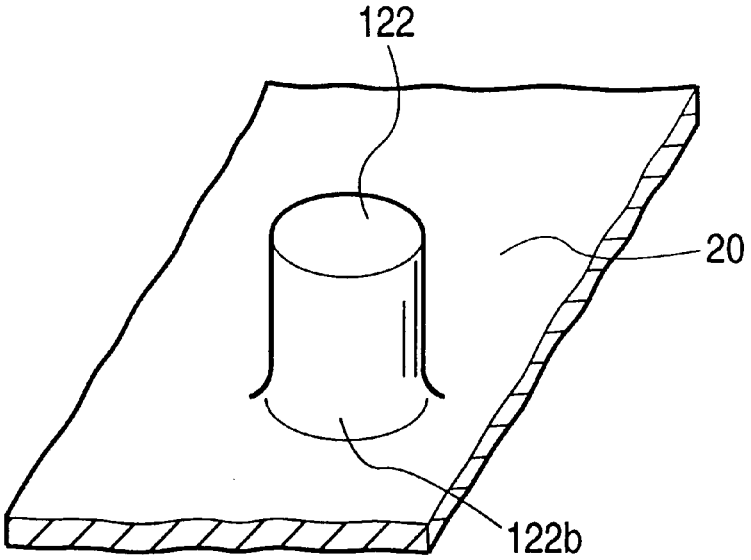
FIG. 6 (b) PRIOR ART
Figure 7:
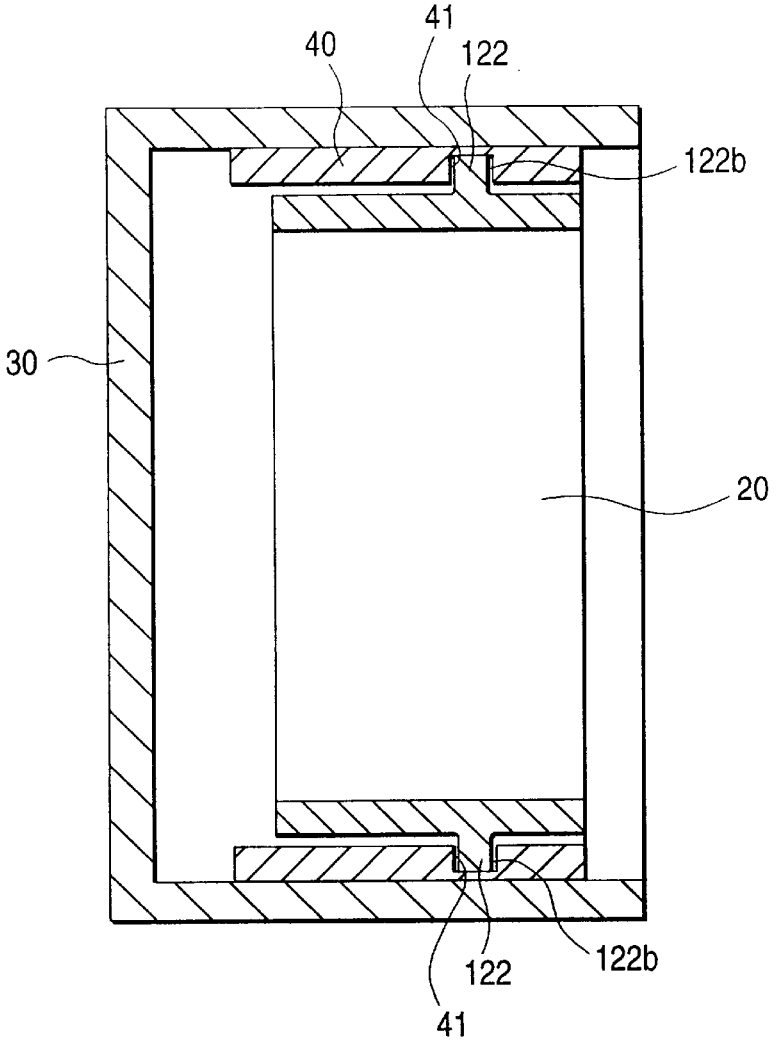
FIG. 7 (a) PRIOR ART
FIG. 7(*a*) is a cross-sectional view of the conventional low insertion force connector.
Figure 7:
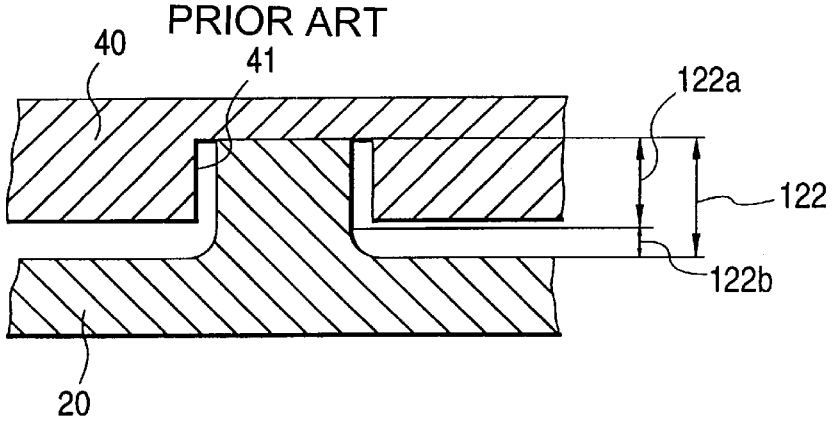
FIG. 7 (b) PRIOR ART

The low insertion force connector of this embodiment is generally similar in construction to the conventional low insertion force connector of FIG. 5 except the construction of the guide pins 21 which form a feature of the present invention.

More specifically, the low insertion force connector of this embodiment comprises male connectors (followers) 10 and 10B, the holder (follower) 20 for receiving the male connectors 10A and 10B, a female connector 30, and a slider (driver) 40. Cam grooves 41, 41, 41 and 41 are formed in the slider 40, and guide pins 21, 21, 21 and 21, corresponding respectively to these cam grooves 41, are formed on the holder 20.

In this construction, the guide pins 21 are first engaged respectively in the cam grooves 41, and then when the slider 40 is linearly moved, the male connectors 10A and 10B, received in the holder 20, are also linearly moved to be fitted into the female connector 30.

As shown in FIGS. 1 and 2, the guide pins 21 are formed on and project from each of upper and lower side walls of the holder 20, and radiused grooves 22, 22, 22 and 22 of an arcuate cross-section are formed in the surfaces of the holder 20 from which the guide pins 21 project, and each radiused groove 22 is continuous with a proximal end of the associated guide pin 21.

The dimensions (the radius of curvature, the width of the groove, and so on) of each radiused groove 22 are determined by the thickness of the side wall of the holder 20, a load acting on the guide pin 21, and so on, and these dimensions can be so determined that a stress, acting on the proximal end of the guide pin 21, can be dissipated while securing the strength of the side wall of the holder 20.

In the low insertion force connector of this embodiment, having the above construction, that portion around the proximal end of each guide pin 21 is chamfered to form the radiused groove 22, and by doing so, the length of projecting of the guide pin 21 can be reduced.

With this construction, the concentration of the stress on the guide pin 21 due to a notch effect can be alleviated while achieving a compact design of the connector.

When each guide pin 21 is engaged in the associated cam groove 41, the radiused groove 22 will not interfere with the slider 40, and therefore any clearance will not be formed between the slider 40 and the surface from which the guide pin 21 projects.

Therefore, when the slider 40 is in contact with the surfaces, from which the guide pins 21 project, and is slid, the load, acting on those surfaces of each cam groove 41 and the associated guide pin 21 which are held in sliding contact with each other, can be reduced, and therefore the production of an abnormal sound due to the friction between the cam groove 41 and the guide pin 21 is positively prevented.

Next, a second embodiment of a low insertion force connector (motion transmission mechanism) of the invention will be described.

Figure 4:
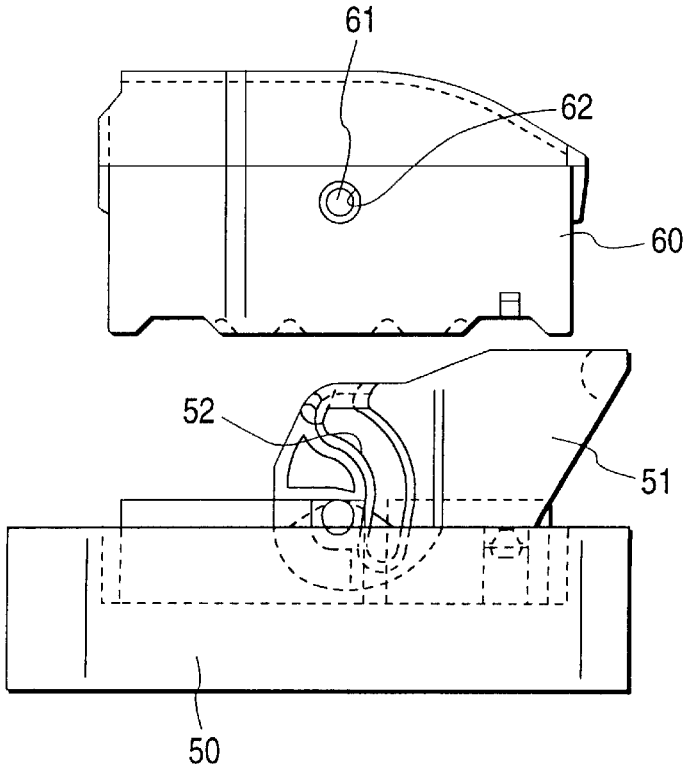
FIG. 4 is a side-elevational view of a second embodiment of a low insertion force connector of the invention.

FIG. 4 is a side-elevational view of the second embodiment of the low insertion force connector of the invention.

In this Figure, the low insertion force connector of this embodiment comprises a male connector 50, a lever (driver) 51, rotatably mounted on the male connector 50, and a female connector (follower) 60. Cam grooves 52 and 52 are formed respectively in opposite sides of the lever 51, and guide pins 61 and 61, corresponding respectively to these cam grooves 52, are formed on and project from opposite sides of the female connector 60, respectively.

In this construction, the guide pins 61 are first engaged respectively in the guide grooves 52, and then when the lever 51 is angularly moved, the female connector 60 is linearly moved to be fitted into the male connector 50.

Radiused grooves 62 and 62 of an arcuate cross-section are formed respectively in the surfaces of the female connector 60 from which the guide pins 61 project, respectively, and each radiused groove 62 is continuous with a proximal end of the associated guide pin 61.

In the low insertion force connector of this construction, also, the concentration of the stress on each guide pin 61 due to a notch effect can be alleviated while achieving a compact design of the connector, and also the production of an abnormal sound can be positively prevented as described above for the first embodiment.

The motion transmission mechanisms and low insertion force connectors of the present invention are not limited to the above embodiments.

For example, the motion transmission mechanisms of the invention can be applied not only to the low insertion force connector but also to various motion transmission mechanisms (e.g. a top loading mechanism for an optical disk) using cam grooves and guide pins.

The low insertion force connectors of the invention are not limited to the above embodiments, but can be applied to various low insertion force connectors using cam grooves and guide pins.

As described above, in the motion transmission mechanisms and low insertion force connectors of the invention, the concentration of the stress on each guide pin due to the notch effect can be alleviated while achieving the compact design of the connector, and also the production of an abnormal sound can be positively prevented.

What is claimed is:

1. A motion transmission mechanism comprising:

a driver for imparting a motion;

cam grooves formed in said driver;

a follower for receiving said-motion;

guide pins formed on said follower, said driver and said follower connected together with said guide pins being engaged respectively in said cam grooves, when said driver is moved, said guide pins are moved respectively along said cam grooves to move said follower; and radiused grooves of an arcuate cross-section formed in surfaces from which said guide pins project, each of said radiused grooves being continuous with a proximal end of each of said guide pins.

2. A motion transmission mechanism according to claim 1, in which when said driver is moved linearly, said follower is moved linearly.

3. A motion transmission mechanism according to claim 1, in which when said driver is rotated, said follower is moved linearly.

4. A low insertion force connector comprising:

an operating member for imparting a motion;

cam grooves formed in said operating member;

guide pins formed on a connector for receiving the motion, and said operating member and said connector are connected together with said guide pins being engaged respectively in said cam grooves, and when said operating member is moved, said guide pins are moved respectively along said cam grooves so that said connector is moved to be fitted in a mating connector; and radiused grooves of an arcuate cross-section are formed in those surfaces from which said guide pins project, each of said radiused grooves being continuous with a proximal end of each of said guide pins.

5. A low insertion force connector according to claim 4, in which said operating member is a linearly-movable slider, and when said slider is moved linearly, said connector is moved linearly to be fitted into the mating connector.

6. A low insertion force connector according to claim 4, in which said operating member is a rotary member, and when said rotary member is rotated, said connector is moved linearly to be fitted into the mating connector.

7. The motion transmission mechanism of claim 1, wherein said guide pins are integral with said follower.

8. The lower insertion force connector of claim 4, wherein said guide pins are integral with said connector.

* * * * *